US005297936A

United States Patent [19]

Sato

[11] Patent Number: 5,297,936

[45] Date of Patent: Mar. 29, 1994

[54] COUPLING FAN

[75] Inventor: Youji Sato, Seto, Japan

[73] Assignee: Aisin Kako Kabushiki Kaisha, Aichi, Japan

[21] Appl. No.: 64,938

[22] Filed: May 24, 1993

Related U.S. Application Data

[62] Division of Ser. No. 828,568, Jan. 31, 1992.

[51] Int. Cl.[5] ..... F04D 29/32

[52] U.S. Cl. ..... 416/204 R; 416/244 R; 403/220

[58] Field of Search ..... 416/204 R, 204 A; 403/220, 291

[56] References Cited

U.S. PATENT DOCUMENTS

| | | | |
|---|---|---|---|
| 1,255,346 | 2/1918 | Sparks | 416/204 R |
| 1,898,628 | 2/1933 | Hollerith | 416/204 R |
| 3,912,375 | 10/1975 | Franklin, Sr. | 416/204 R |
| 3,985,000 | 10/1976 | Hartz | 440/220 |
| 4,180,024 | 12/1979 | Hernandez | 416/244 R |
| 4,692,053 | 9/1987 | Sampedro | 416/244 R |
| 5,083,904 | 1/1992 | Masatsugu et al. | 416/204 R |

FOREIGN PATENT DOCUMENTS

| | | | |
|---|---|---|---|
| 1260071 | 3/1961 | France | 416/204 R |

*Primary Examiner*—John T. Kwon

*Attorney, Agent, or Firm*—Oblon, Spivak, McClelland, Maier & Neustadt

[57] ABSTRACT

A coupling fan includes a fan body, a coupling and a mounting plate. The mounting plate includes a substantially ring-shaped base member and a substantially strip-shaped movable member having spring elasticity. The base member is connected to a boss of the fan body or an operating member of the coupling. The movable member is connected to the base member at its one end, and it is further connected to the boss of the fan body or the operating member of the coupling, to which the base member is not connected, at its another end. With this construction, not only vibrations of the fan body and the coupling are absorbed by the movable member, but also an overall inside diameter of the mounting plate can be made greater. Namely, a coupling having a larger outside diameter can be employed, and accordingly the cooling efficiency of the coupling can be improved. Hence, the coupling fan can be improved in its durability.

2 Claims, 6 Drawing Sheets

COUPLING FAN

This is a division of application Ser. No. 07/828,568, filed on Jan. 31, 1992.

BACKGROUND OF THE INVENTION

1. Field of the Invention

The present invention relates to a Coupling fan which is employed in an automobile engine cooling system or the like.

2. Description of the Related Art

A fan is disposed in an automobile engine cooling system, and it is driven by rotations of an engine which is adapted for the driving source. The fan rotates to deliver winds to a radiator, thereby carrying out the heat exchange between hot cooling water and cold cooling water in the radiator. So far, this fan has been connected mechanically to an engine crank shaft by means of a belt or the like, and it has been directly driven rotatively. However, a coupling fan which is indirectly driven rotatively by means of fluid viscous resistance has come to be employed recently.

As illustrated in FIG. 13, this coupling fan includes a fan body 100 and a mounting plate 200. The fan body 100 is installed to a coupling 300 by way of the mounting plate 200.

The fan body 100 includes a cylinder-shaped boss 101, and a plurality of blades 102 which are disposed on an outer peripheral surface of the boss 101 at predetermined intervals in a circumferential direction and which project substantially radially. When the fan body 100 rotates, the blades 102 deliver winds from a radiator which is disposed at a position opposite to the coupling 300.

The mounting plate 200 is a thin plate-shaped member, and it is formed in a ring-like shape which has an opening at a center thereof. This mounting plate 200 is fixed to the boss 101 of the fan body 100, and at the same time it is fixed to an operating member 301 of the coupling 300.

The coupling 300 mainly includes a driving shaft 302 which is connected to an engine crank shaft, a driving plate 303 which is connected to the driving shaft 302, an operating member 301 which is disposed at a position opposite to the driving plate 303 and rotatably held by the driving shaft 302, and a silicone oil which is interposed between the operating member 301 and the driving plate 303. Rotary forces of the driving plate 303 are transmitted to the operating member 301 by way of viscous resistance of the silicone oil, and they rotate the fan body 100 by way of the mounting plate 200 which is installed to the operating member 301.

As high output performance has been required for automobile engines recently, vibrations of coupling fans which are connected to the automobile engines have enlarged. Accordingly, improvement has been longed for durability of the coupling fans. In Unexamined Japanese Utility Model Publication (Kokai) No. 66,094/1981, a vibration isolator type coupling fan is disclosed. In the coupling fan, a mounting plate is provided with a spring operation in order to give a vibration damping performance to the coupling fan. As illustrated in FIG. 14, this mounting plate includes a ring-shaped base member 400 and a plurality of extending members 401 which project radially inward from the base member 400 and which extend in a circumferential direction. The base member 400 is provided with a plurality of holes 402, whereby it is fixed to a fan body 100. In addition, a guide surface 403 is disposed at a front end of the extending members 401. The guide surfaces 403 are brought into contact with a coupling 300, thereby positioning the mounting plate. A hole 404 is further disposed at the front end of the extending members 401, whereby the extending members 401 are fixed to an operating member 301 of the coupling 300. All in all, the entire mounting plate is formed of a plate spring, and accordingly it is intended to absorb vibrations mainly in an axial direction by means of spring elasticity of the extending members 401.

In the above-described coupling fans, it has been known that durability of the viscous substance such as the silicone oil filled therein affects engine cooling performance of the coupling fan greatly. In short, as the viscous substance degrades, its viscosity degrades. Hence, the rotary forces of the driving plate 303 cannot be transmitted to the operating member 301 sufficiently, thereby resulting in reduction of a number of revolutions of the fan body 100. Most of the degradation of the filled viscous substance results from heat. Therefore, it is preferred to cool the coupling 300 and thereby cool the viscous substance in order to inhibit the viscous substance from degrading. Accordingly, it is possible to think of improving the cooling efficiency by increasing an outside diameter of the coupling 300 so as to enlarge an area of cooling fins 304 which are formed on a surface of the coupling 300 illustrated in FIG. 13.

However, it has been very crowded in automobile engine rooms recently. Hence, it is not preferred to enlarge a size of the fan body 100. Consequently, it is preferred to enlarge an outside diameter of the coupling 300 only while maintaining a current configuration of the fan body 100. If such is possible, however, the mounting plate 200 should be down-sized in width. Even when a coupling fan employs the mounting plate illustrated in FIG. 14 which has the vibration damping performance, the extending members 401 should be down-sized in width as well, and such down-sizing results in a strength problem. In the worst case, the mounting plate cannot be provided with the extending members 401.

In addition, in the mounting plate illustrated in FIG. 14 and employed by the vibration isolator type coupling fan, complex forces including forces in an axial direction, forces in a rotary direction, forces in a radial direction and the like act on the extending members 401. As a result, torsional forces act on the extending members 401. Hence, when the extending members 401 have a narrow width, there has been a fear for breakages of the extending members 401 which result from metal fatigue.

SUMMARY OF THE INVENTION

The present invention has been developed in view of the above-mentioned circumstances. It is therefore an object of the present invention to provide a coupling fan in which a vibration damping performance as well as an enhanced durability are given to its mounting plate by improving a configuration of its mounting. It is a further object of the present invention to provide a coupling fan which enables to enlarge an outside diameter of its coupling without ever increasing a current size of its fan body.

A first aspect of a coupling fan according to the present accomplishes the above-mentioned objects, which comprises:

a fan body including a substantially cylinder-shaped boss, and a plurality of blades disposed on an outer peripheral surface of the boss at predetermined intervals in a circumferential direction and projecting substantially radially;

a coupling including a driving member connected to a rotary driving source, and an operating member connected to the driving member by way of a viscous substance whose viscous resistance transmits rotation of the driving member to the operating member so as to rotate the operating member; and a substantially ring-shaped mounting plate fixed to the boss of the fan body and the operating member of the coupling so as to transmit rotation of the operating member to the fan body, and including a substantially ring-shaped base member connected to one of the boss of the fan body and the operating member of the coupling and a substantially strip-shaped movable member having spring elasticity, connected to the base member at one end thereof and connected to another one of the boss of the fan body and the operating member of the coupling at another end thereof.

The fan body and the coupling can employ those identical to the conventional ones. As for the coupling, it can employ one which has an outside diameter greater than that of the conventional one.

One of the major features of the first aspect of the coupling fan according to the present invention is that the mounting plate includes two members, i.e., the base member and the movable member. The base member is formed in a substantially ring shape, and it is connected to one of the boss of the fan body and the operating member of the coupling by means of a plurality of mounting portions which are disposed at predetermined intervals in a circumferential direction.

The movable member is formed in a substantially strip shape, and it has spring elasticity. Further, the movable member is superimposed on the base member in an axial direction and connected thereto at its one end, and it is connected to another one of the boss of the fan body and the operating member of the coupling by means of a mounting portion which is disposed at its another end.

In the first aspect of the coupling fan according to the present invention, the fan body can be connected to the coupling by way of the movable member which can be deformed elastically. Hence, vibrations of the fan body and the coupling can be absorbed by means of elastic deformation of the movable member.

The mounting portion of this movable member can be disposed either inward or outward with respect to the mounting portions of the base member. However, it is preferred to dispose the mounting portion of the movable member and the mounting portions of the base member on an identical circumference. With this construction, stresses can be made to act on the base member and the movable member in a substantially coinciding direction during the rotation of the fan body. As a result, torsional forces or the like can be inhibited from acting on the movable member, and accordingly the movable member can be inhibited from breaking.

In addition, it is preferred to form a guide surface which is brought into contact with the coupling on an innermost peripheral surface of either one of the base member and the movable member which is happened to be disposed inward. With this construction, the mounting plate can be positioned with respect to the fan body and the coupling in a radial direction with ease.

In the first aspect of the coupling fan according to the present invention, one of the boss of the fan body and the operating member of the coupling is fixed to the substantially ring-shaped base member of the mounting plate, one end of the substantially strip-shaped movable member is fixed to the base member, and another one of the boss of the fan body and the operating member of the coupling is fixed to another end of the movable member. Since this movable member has the spring elasticity, it absorbs the vibrations transmitted from the driving source. As a result, the coupling fan can be improved in its durability, and it can inhibit disturbing noises from generating.

The conventional mounting plate having the vibration damping performance and illustrated in FIG. 14 has been integrally formed by punching out a metal plate. Accordingly, the extending members 401 are positioned limitedly on the inward side with respect to the base member 400, and the guide surface 403 should be formed on the extending members 401. On the other hand, in the first aspect of coupling fan according to the present invention, the movable member is superimposed on and connected to the base member at its one end in an axial direction. Hence, the movable member and the base member can be placed at a substantially identical position in a radial direction, and an overall inside diameter of the present mounting plate can be made greater than that of the conventional mounting plate. Further, the guide surface can be formed on a surface of either of the movable member and the base member which is happened to be placed on the inward side, and accordingly an inside diameter of the guide surface can be made greater than that of the conventional guide surface. Namely, the outside diameter of the coupling can be enlarged. With this enlargement, the cooling efficiency of the coupling is improved, and consequently the viscous substance is inhibited from degrading and the durability of the viscous substance is improved further.

In the first aspect of the coupling fan according to the present invention, not only the vibrations are absorbed similarly even when a fan body is employed which has a configuration identical to the conventional one, but also a coupling can be employed which has a larger outside diameter than that of the conventional one. Therefore, the cooling efficiency of the coupling is improved, and the viscous substance is inhibited from deteriorating even when an engine speed is raised compared with the conventional engine speed. Thus, it is possible to establish a high durability. Moreover, the coupling fan can hardly diminish a space in an engine room.

A second aspect of a coupling fan according to the present also accomplishes the above-mentioned objects, which comprises:

a fan body including a substantially cylinder-shaped boss, and a plurality of blades disposed on an outer peripheral surface of the boss at predetermined intervals in a circumferential direction and projecting substantially radially;

a coupling including a driving member connected to a rotary driving source, and an operating member connected to the driving member by way of a viscous substance whose viscous resistance transmits rotation of the driving member to the operating member so as to rotate the operating member; and a substantially ring-shaped mounting plate fixed to the boss of the fan body and the operating member of the coupling so as to transmit rotation of the operating member to the fan body, and including a substantially ring-shaped base member and a substantially strip-shaped movable member cut out of and projected from the base member integrally, the base member including a first fixing portion connected to one of the boss of the fan body and the operating member of the coupling, the movable member including a second fixing portion connected to another one of the boss of the fan body and the operating member of the coupling, and the first fixing portion of the base member and the second fixing portion of the movable member being disposed on an identical circumference.

The fan body and the coupling can employ those identical to the conventional ones. As for the coupling, it can employ one which has an outside diameter greater than that of the conventional one.

One of the features of the second aspect of the coupling fan according to the present invention is a configuration of the mounting plate. This mounting plate includes the ring-shaped base member and the substantially strip-shaped movable member. The base member is connected to one of the boss of the fan body and the operating member of the coupling by means of the first fixing portion. The movable member starts from the base member at an end thereof and extends in a circumferential direction, it is connected to the base member at one end thereof, and it is connected to another one of the boss of the fan body and the operating member of the coupling by means of the second fixing portion which is disposed at another end thereof. Further, the movable member has spring elasticity, and its elastic deformation absorbs vibrations.

Major feature of the second aspect of the coupling fan according to the present invention is that the first fixing portion of the base member and the second fixing portion of the movable member are disposed on an identical circumference. With this construction, stresses can be made to act on the first fixing portion and the second fixing portion in a substantially coinciding direction during the rotation of the fan body. As a result, torsional forces or the like can be inhibited from acting on the movable member, and accordingly the movable member can be inhibited from breaking.

In addition, the mounting plate including the base member and the movable member can be integrally formed of a metal plate having spring elasticity. Moreover, it is preferred to form a guide surface which is brought into contact with the coupling on an end surface of either one of the base member and the movable member which is happened to be disposed inward. With this construction, the mounting plate can be positioned with respect to the fan body and the coupling in a radial direction with ease.

In the second aspect of the coupling fan according to the present invention, the ring-shaped base member of the mounting plate is fixed to one of the boss of the fan body and the operating member of the coupling at its first fixing portion, and the movable member is fixed to another one of the boss of the fan body and the operating member of the coupling at its second fixing portion which extends from the base member in a circumferential direction and terminates at another end. The movable member absorbs the vibrations transmitted from the driving source in an axial direction. As a result, the coupling fan can be improved in its durability against the thermal degradation, and it can inhibit disturbing noises from generating.

The conventional mounting plate having the vibration damping performance and illustrated in FIG. 14 has been formed from a planar viewpoint, for instance, by punching out a metal plate. Accordingly, the extending members 401 are formed at positions on the inward side with respect to the base member 400. Hence, stresses act on the fixing portions 402 of the base member 400 and the fixing portions 404 of the extending members 401 in different directions during the rotation of the fan body. Further, an overall width of the mounting plate is made larger. On the other hand, in the second aspect of the coupling fan according to the present invention, the movable member extends from the base member in the present mounting plate, and the first fixing portion of the base member and the second fixing portion of the movable member are disposed on an identical circumference. Therefore, stresses can be made to act on the first fixing portion and the second fixing portion in a substantially coinciding direction during the rotation of the fan body. As a result, no torsional forces or the like occur, and the present mounting plate is improved in the durability in view of the strength. Further, an overall width of the present mounting plate can be made less than that of the conventional mounting plate, and an overall inside diameter of the present mounting plate can be made greater than that of the conventional mounting plate. Accordingly, the outside diameter of the coupling can be enlarged. With this enlargement, the cooling efficiency of the coupling is improved, and consequently the viscous substance is inhibited from degrading and the durability of the viscous substance is improved further.

In the second aspect of the coupling fan according to the present invention, not only the vibrations are absorbed similarly even when a fan body is employed which has a configuration identical to the conventional one, but also a coupling can be employed which has a larger outside diameter than that of the conventional one. Therefore, the cooling efficiency of the coupling is improved, and the viscous substance is inhibited from deteriorating even when an engine speed is raised compared with the conventional engine speed. The mounting plate itself is improved in the durability, and consequently a much higher durability can be given to the coupling fan. Moreover, the coupling fan can hardly diminish a space in an engine room.

A third aspect of a coupling fan according to the present also accomplishes the above-mentioned objects, which comprises:

a fan body including a substantially cylinder-shaped boss, and a plurality of blades disposed on an outer peripheral surface of the boss at predetermined intervals in a circumferential direction and projecting substantially radially;

a coupling including a driving member connected to a rotary driving source, and an operating member connected to the driving member by way of a viscous substance whose viscous resistance transmits rotation of the driving member to the operating member so as to rotate the operating member; and a substantially ring-shaped mounting plate fixed to the boss of the fan body and the operating member of the coupling so as to transmit rotation of the operating member to the fan body,. and including a substantially cylinder-shaped base member buried in and fixed integrally to the boss of the fan body and a plurality of substantially plate-shaped movable members having spring elasticity, the movable members including a fixing portion protruding from at an end surface of the base member inwardly in a radial direction of the boss of the fan body, bending in a letter "L"-like shape, extending in a circumferential direction and connected to the operating member of the coupling.

The fan body can employ one identical to the conventional one.

The mounting plate includes the substantially cylinder-shaped base member and a plurality of the substantially plate-shaped movable members which extend from the base member. The movable members include a fixing portion which is disposed at an end thereof and which is fixed to the operating member of the coupling. One of the major features of the third aspect of the coupling fan according to the present invention is that the base member is buried in and fixed integrally to the boss of the fan body. With this construction, it is made unnecessary to provide a space for accommodating the base member of the mounting plate in the coupling, and at the same time an overall width of the mounting plate can be made less.

This mounting plate can be integrally formed of a metal plate having spring elasticity, or the base member and the movable members can be formed independently and thereafter they can be fixed so as to form the mounting plate. In the latter case, only the movable members can be formed of a metal having spring elasticity. In addition, it is preferred to form a guide surface which is brought into contact with the coupling on an end surface of the movable members. With this construction, the mounting plate can be positioned with respect to the coupling in a radial direction with ease.

When connecting the mounting plate and the fan body, the base member and the movable members can be formed independently in advance, and thereafter the base member can be buried in the fan body. However, it is preferred to utilize the insert molding in which the fan body is molded onto the base member after disposing the whole mounting plate in a mold for molding the fan body.

In the third aspect of the coupling fan according to the present invention, the cylinder-shaped base member of the mounting plate is buried in and fixed to the boss of the fan body integrally, and only the movable members are protruded inward from the boss. Hence, the inside diameter of the movable members can be made greater than those of the conventional ones by a dimension of the base member, and accordingly a coupling can be employed which has an enlarged outside diameter by the dimension. With this enlargement, the cooling efficiency of the coupling is improved, and consequently the viscous substance is inhibited from degrading and the durability of the viscous substance is improved further.

Moreover, when an inside diameter of the movable members is made identical to that of the conventional ones, the outside diameter of the mounting plate can be made less than that of the conventional one. Consequently, a length of the blades can be prolonged radially inward, and thereby an area of the blades can be enlarged. As a result, the cooling efficiency of the fan body is improved. Even if such is the case, the coupling fan can hardly diminish a space in an engine room.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIGS. 1 through 4 relate to a First Preferred Embodiment of a coupling fan according to the present invention, wherein:

FIG. 1 illustrates a partly cut out overall plan view of the First Preferred Embodiment;

FIG. 2 illustrates a cross sectional view of a major portion thereof;

FIG. 3 illustrates an overall plan view of a mounting plate thereof; and

FIG. 4 illustrates a cross sectional view of a major portion of the mounting plate thereof;

FIGS. 6 and 7 relate to a Third Preferred Embodiment of a coupling fan according to the present invention, wherein:

FIG. 6 illustrates a plan view of a major portion of a mounting plate of the Third Preferred Embodiment; and FIG. 7 illustrates a cross sectional view of a major portion of the mounting plate thereof;

FIGS. 8 and 9 relate to a Fourth Preferred Embodiment of a coupling fan according to the present invention, wherein:

FIG. 8 illustrates a plan view of a major portion of a mounting plate of the Fourth Preferred Embodiment; and FIG. 9 illustrates a cross sectional view of a major portion of the mounting plate thereof;

FIGS. 11 and 12 relate to a Sixth Preferred Embodiment of a coupling fan according to the present invention, wherein:

FIG. 11 illustrates a plan view of a major portion of the Sixth Preferred Embodiment; and FIG. 12 illustrates a cross sectional view taken along the line XII—XII of FIG. 11;

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

Figure 1:
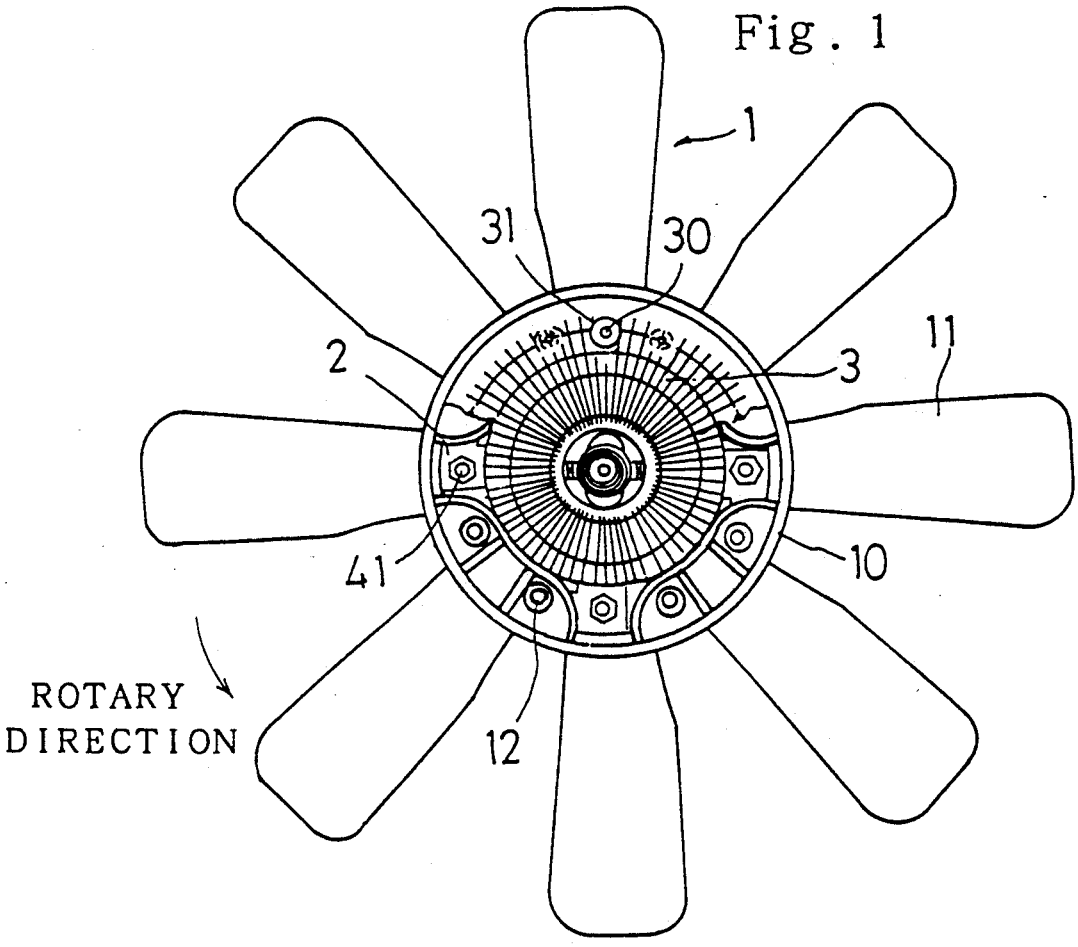
Figure 2:
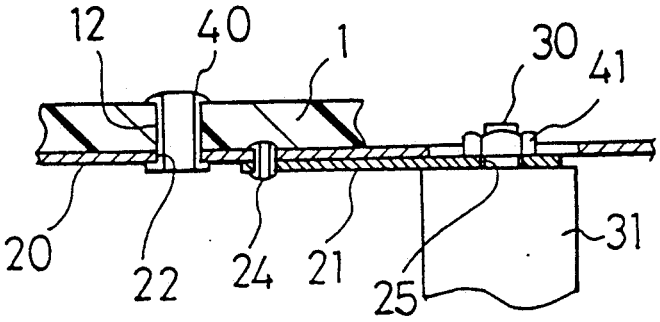

FIGS. 1 and 2 illustrate an overall construction of the First Preferred Embodiment of the coupling fan according to the present invention. This coupling fan comprises a fan body 1 which is made of resin, a mounting plate 2 and a coupling 3. The fan body 1 is installed to the coupling 3 by way of the mounting plate 2.

The fan body 1 includes a cylinder-shaped boss 10 and a plurality of blades 11 which are disposed on an outer peripheral surface of the boss 10 at predetermined intervals in a circumferential direction and which project substantially radially. When the fan body 1 rotates, the blades 11 deliver winds from a radiator which is disposed at a position opposite to the coupling 3. In a bottom surface of the boss 10, eight plate mounting holes 12 are formed at predetermined intervals in a circumferential direction. The mounting plate 2 is installed to the boss 10 of the fan body 1 with rivets which are assembled in the plate mounting holes 12.

Figure 3:
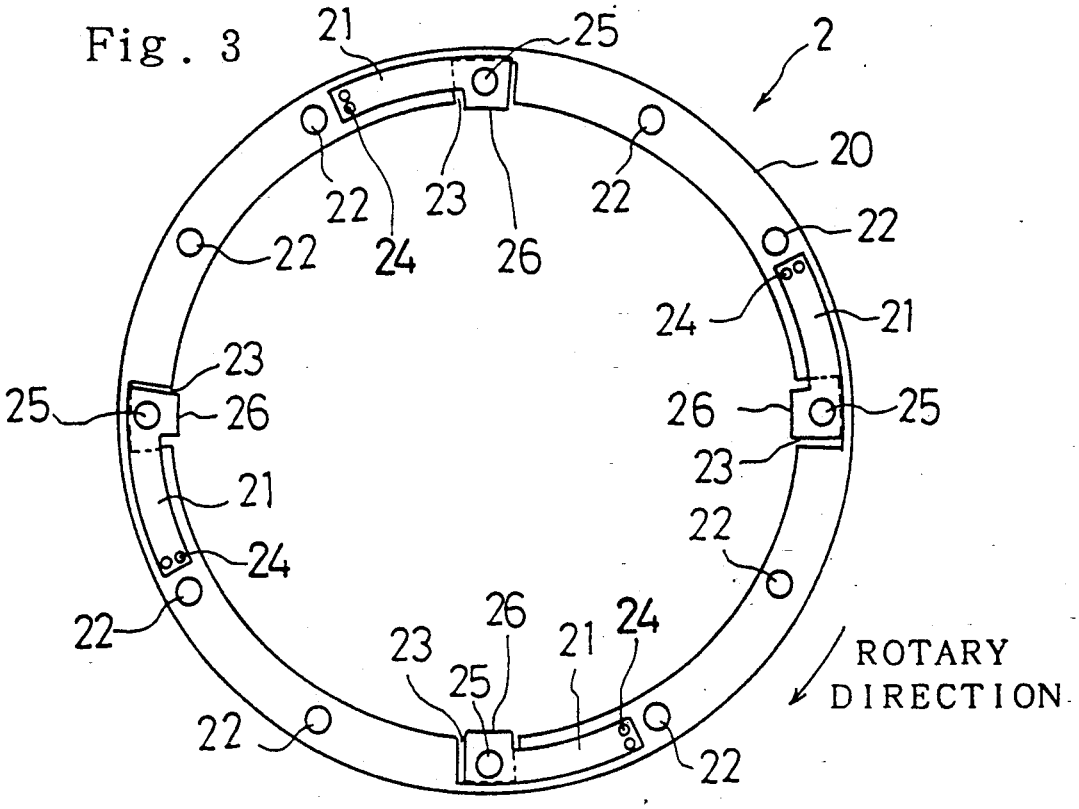
Figure 4:
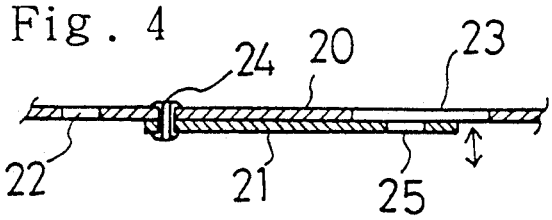

The mounting plate 2 is made of a metal plate, and it is formed in a thin plate shape. As illustrated in FIGS. 3 and 4, the mounting plate 2 includes a ring-shaped base member 20 and four strip-shaped movable members 21 which are connected to the base member 20 at one end thereof.

The base member 20 has eight first fixing portions 22, which are formed as a through hole, at positions which correspond to the plate mounting holes 12 of the fan body 1. Further, the base member 20 has four cut-offs 23 which are cut off from the inner peripheral side to the outer peripheral side and which are formed at four equally spaced positions away from each other in a degree of 90°.

The strip-shaped movable members 21 are fixed to the base member 20 with rivets 24 at one end thereof, and they extend in a clockwise direction in FIG. 3 and terminate in the cut-off 23 of the base member 20 at another end thereof, respectively. At another end of the strip-shaped movable members 21, there is provided a second fixing portion 25 which is formed as a through hole. The first fixing portions 22 and the second fixing portions 25 are disposed on an identical circumference. Further, the strip-shaped movable members 21 has a guide surface 26 which is formed on an end surface thereof facing radially inward at another end thereof. Here, the movable members 21 are formed of spring steel, and accordingly they are made elastically deformable around at the one end thereof which is fixed with the rivets 24.

Figure 13:
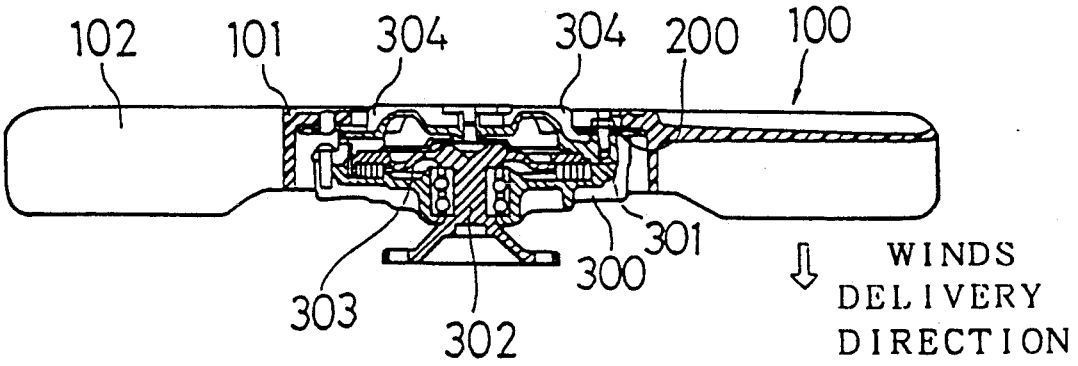
Fig. 13 (PRIOR ART)
FIG. 13 illustrates an explanatory cross sectional view of a construction of a conventional coupling fan.
Figure 14:
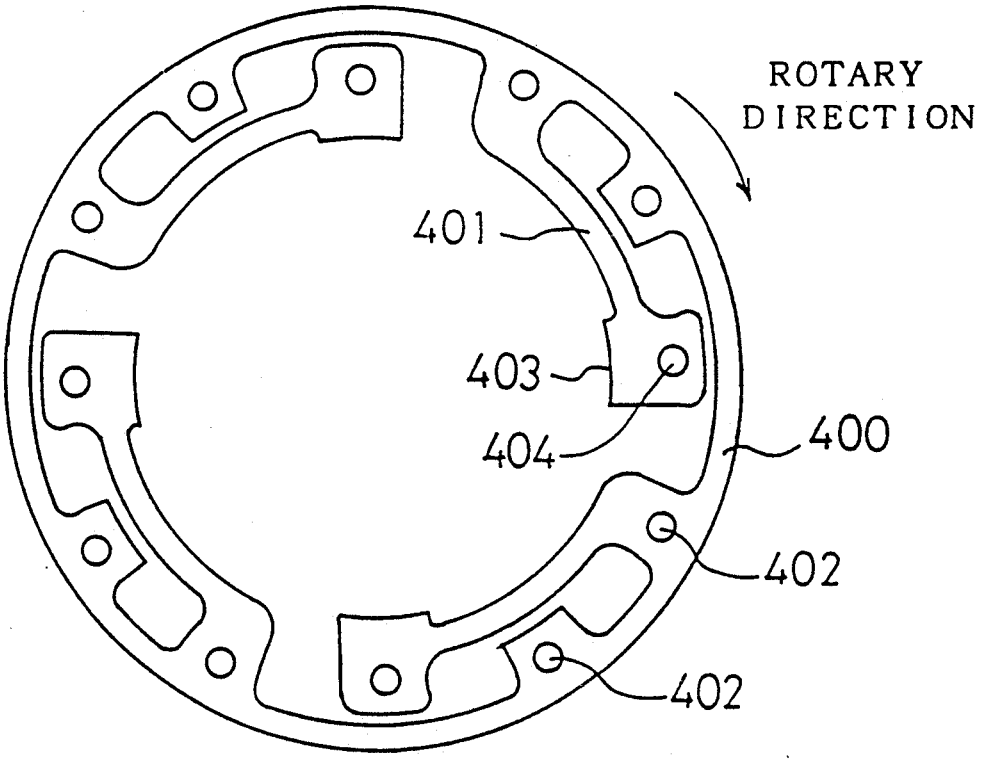
Fig. 14 (PRIOR ART)
FIG. 14 illustrates a plan view of a conventional mounting plate of another conventional coupling fan.

The coupling 3 employs one which is identical to the conventional coupling 300 illustrated in FIG. 13. Since the coupling 300 has been described in detail in the "Description of the Related Art" section, it will not be described herein. However, as illustrated in FIG. 2, the operating member 301 of the coupling 3 has four mounting portions 31 which project in an axial direction and which have a bolt 30. The mounting portions 31 are formed symmetrically at four equally spaced positions away from each other in a degree of 90°.

When constructing the First Preferred Embodiment of the coupling fan according to the present invention, the fan body 1 and the mounting plate 2 are superimposed at a position where the plate mounting holes 12 and the first fixing portions 22 align, and thereafter they are fixed integrally with rivets 40, as illustrated in FIG. 2. At this moment, the fan body 1 is brought into contact with and fixed to a surface of the base member 20 which is opposite to its surface provided with the movable members 21. Then, the guide surfaces 26 of the movable members 21 are brought into contact with side peripheral surfaces of the coupling 3 in order to position the mounting plate 2 with respect to the coupling 3, and bolts 30 of the coupling 3 are inserted into the second fixing portions 25 of the movable members 21. Finally, the nuts 41 are tightened in order to fix the movable members 21 of the mounting plate 2 to the mounting portions 31 of the coupling 3.

In the First Preferred Embodiment of the coupling fan according to the present invention, since the first fixing portions 22 of the base member 20 and the second fixing portions 25 of the movable members 21 are disposed on an identical circumference, stresses can be made to act on the first fixing portions 22 and the second fixing portions 25 in a substantially coinciding direction during the rotation of the fan body 1. Therefore, torsional forces or the like are inhibited from acting on the movable members 21, and accordingly problems such as breakages of the mounting plate 2 or the like are inhibited from occurring. As a result, the coupling fan is improved in the durability.

Further, in the First Preferred Embodiment of the coupling fan according to the present invention, the vibrations of the fan body 1 and the vibrations of the coupling 3 are absorbed by the elastic deformations of the movable members 21 of the mounting plate 2. Thus, the coupling fan constitutes a vibration isolator type coupling fan. Furthermore, in this First Preferred Embodiment, since the base member 20 and the movable members 21 of the mounting plate 2 are superimposed in an axial direction, an overall width of the mounting plate 2 is reduced, and accordingly the coupling fan 3 can be employed which has a larger outside diameter. Hence, the cooling efficiency of the coupling 3 is improved, and consequently the coupling fan can follow up the trend of the highly raised engine speed. Moreover, the silicone oil or the like in the coupling 3 is inhibited from degrading thermally, and accordingly the durability of the silicone oil or the like is improved further.

Second Preferred Embodiment

Figure 5:
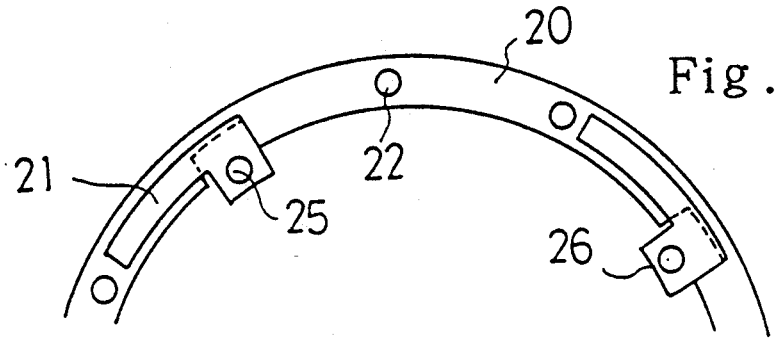
FIG. 5 illustrates a plan view of a major portion of a mounting plate which is employed by a Second Preferred Embodiment of a coupling fan according to the present invention.

In the First Preferred Embodiment having been described so far, the first fixing portions 22 of the base member 20 and the second fixing portions 25 of the movable members 21 are disposed on an identical circumference. However, as illustrated in FIG. 5, in the case that the guide surfaces 26 of the movable members 21 should be disposed further inward radially because of a configuration of the coupling 3, the first fixing portions 22 can be disposed on positions which deviate radially from disposing positions of the second fixing portions 25. Namely, the Second Preferred Embodiment of the coupling fan according to the present invention which has such a construction can be applied to a variety of couplings which have a variety of outside diameters by simply changing the configuration of the movable members 21. Hence, the Second Preferred Embodiment provides a high degree of freedom in design.

Third Preferred Embodiment

Figure 6:
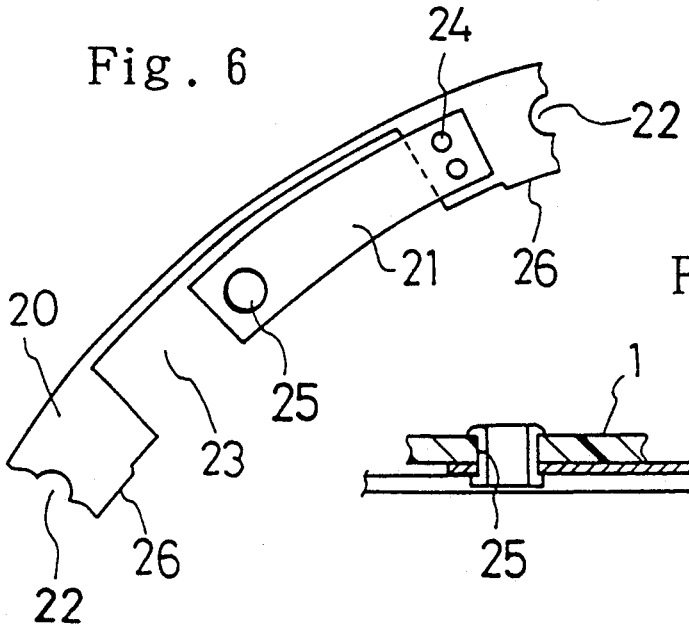
Figure 7:
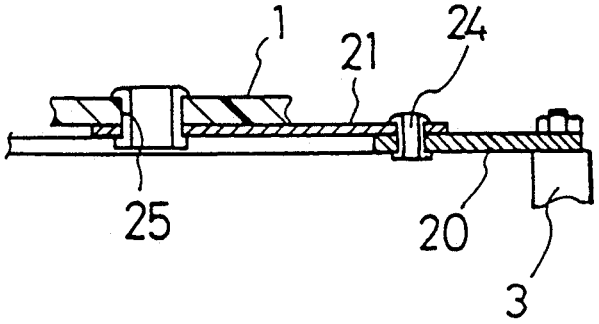

In the First and Second Preferred Embodiments having been described so far, the mounting plate 2 is fixed to the fan body 1 at the base member 20, and it is fixed to the coupling 3 at the movable members 21. However, in the Third Preferred Embodiment of the coupling fan according to the present invention, the mounting plate 2 is fixed to a coupling 3 at first fixing portions 22 of a base member 20, and it is fixed to a fan body 1 at second fixing portions 25 of movable members 21, as illustrated in FIGS. 6 and 7. In addition, guide surfaces 26 are formed on the base member 2. The Third Preferred Embodiment thus constructed can operate and effect advantages similarly to the First Preferred Embodiment at least.

Fourth Preferred Embodiment

Figure 8:
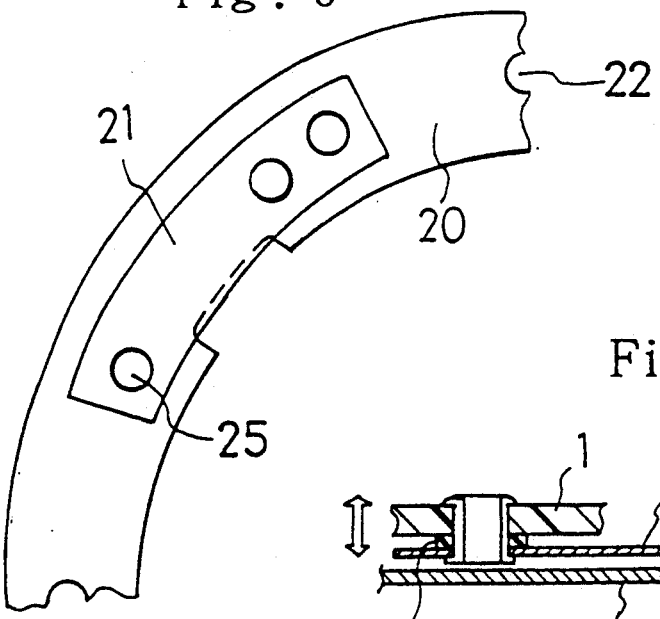
Figure 9:
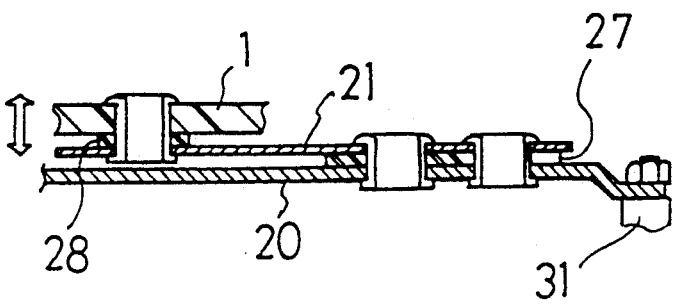
Figure 10:
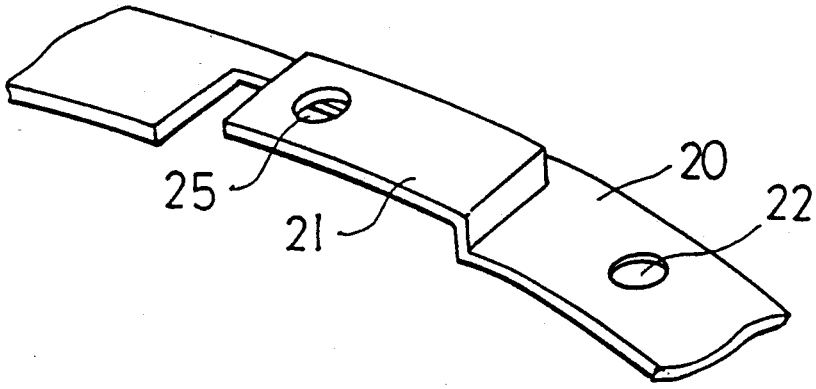
FIG. 10 illustrates a perspective view of a major portion of a mounting plate which is employed by a Fifth Preferred Embodiment of a coupling fan according to the present invention.

In the First, Second and Third Preferred Embodiments having been described so far, the base member 20 of the mounting plate 2 is provided with the cut-offs 23 so as not to restrict the elastic deformations of the movable members 21. However, in the Fourth Preferred Embodiment of the coupling fan according to the present invention, the movable members 21 are fixed to the base member 20 by way of a spacer 27 at one end thereof, and the movable members 21 are further fixed to the fan body 1 by way of a spacer 28 at another end thereof, as illustrated in FIGS. 8 and 9. The Third Preferred Embodiment thus constructed can provide the intended operations and advantageous effects without forming the cut-offs 23 and without inhibiting the movable members 21 from deforming elastically.

Fifth Preferred Embodiment

In the First, Second, Third and Fourth Preferred Embodiments having been described so far, the base member 20 and the movable members 21 of the mounting plate 2 are independent members each other. However, in the Fourth Preferred Embodiment of the coupling fan according to the present invention, a mounting plate 2 is employed in which a base member 20 and movable members 21 are formed integrally. Namely, the base member 20 having spring elasticity is cut and erected integrally at predetermined positions in order to form the movable members 21 in this mounting plate 2. In this Fourth Preferred Embodiment, the mounting plate 2 are connected to a fan body and a coupling in a manner similar to the Third Preferred Embodiment, thereby operating and effecting advantages similarly to the First Preferred Embodiment at least.

Sixth Preferred Embodiment

Figure 12:
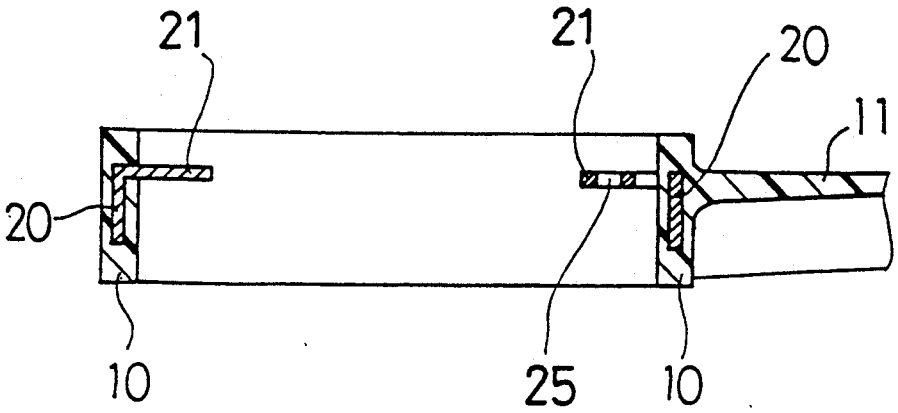
Figure 11:
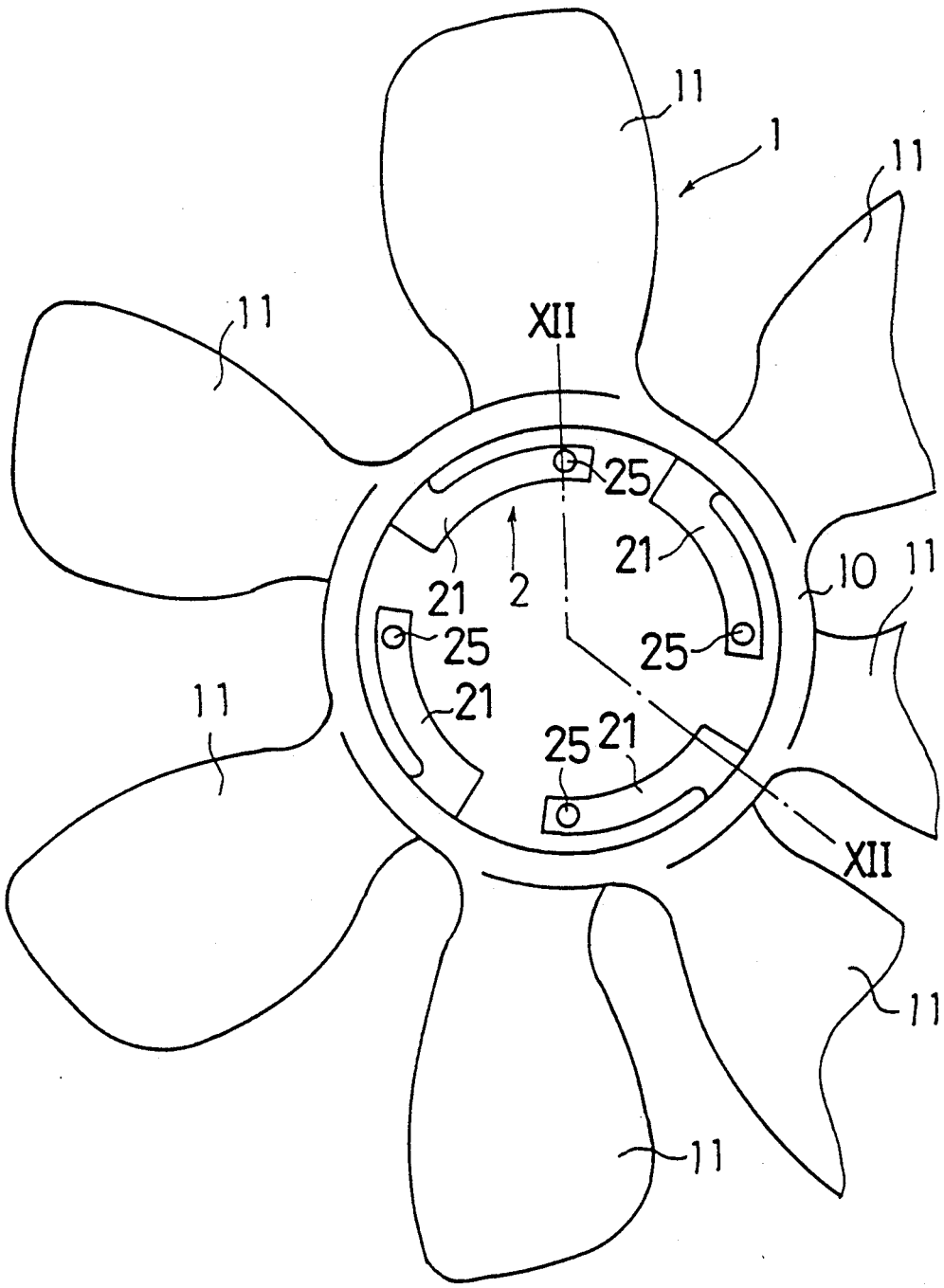

FIGS. 11 and 12 illustrate the Sixth Preferred Embodiment of the coupling fan according to the present invention. This coupling fan is a vibration isolator type coupling fan, and it comprises a fan body 1 which is made of resin, a mounting plate 2 and a coupling (not shown). The fan body 1 is installed to the coupling by way of the mounting plate 2.

The fan body 1 includes a cylinder-shaped boss 10 and a plurality of blades 11 which are disposed on an outer peripheral surface of the boss 10 at predetermined intervals in a circumferential direction and which project substantially radially. When the fan body 1 rotates, the blades 11 deliver winds from a radiator which is disposed at a position opposite to the coupling.

The mounting plate 2 is formed of a spring steel metal plate, and it includes a substantially cylinder-shaped base member 20 and four substantially plate-shaped movable members 20 which project from end surfaces of the base member 20 inward in a radial direction of the boss 10 of the fan body 1 and which further bend and extend in a letter "L" shape in a circumferential direction. The movable members 21 include a mounting hole 25 at a front end thereof. These four movable members 21 are disposed symmetrically at predetermined intervals in a circumferential direction of the boss 10 of the fan body 1. Since these movable members 21 are formed of spring steel, they are made deformable in an axial direction of the boss 10.

This mounting plate 2 is disposed as an insert in a mold before molding the fan body 1. Accordingly, the base member 20 of the mounting plate 2 is buried in the boss 10 of the fan body 1. Thus, the mounting plate 2 is integrally connected to the fan body 1.

This Sixth Preferred Embodiment of the coupling fan according to the present invention is constructed as follows. The movable members 21 of the mounting plate 2 are placed on an operating member of the coupling by inserting bolts which extend from the operating member into their mounting holes 25. Thereafter, the bolts of the operating member of the coupling are assembled with nuts. Thus, the fan body 1 is fixed to the coupling. When the operating member of the coupling rotates, the interposed movable members 21 transmit rotary forces to the fan body 1 so as to rotate the fan body 1. The vibrations resulting from the rotations are absorbed by the elastic deformations of the movable members 21 of the mounting plate 2.

In accordance with the Sixth Preferred Embodiment of the coupling fan according to the present invention, although the outside diameter of the boss 10 of the fan body 1 is maintained identical to that of the conventional one, the movable members 21 of the mounting plate 2 can be disposed at positions further radially outward than the conventional ones. As a result, it is possible to employ a coupling which has a larger outside diameter. Hence, the cooling efficiency of the coupling is improved, and consequently the coupling fan can follow up the trend of the highly raised engine speed. Moreover, the silicone oil or the like in the coupling is inhibited from degrading thermally, and accordingly the durability of the silicone oil or the like is improved further.

Having now fully described the present invention, it will be apparent to one of ordinary skill in the art that many changes and modifications can be made thereto without departing from the spirit or scope of the present invention as set forth herein including the appended claims.

What is claimed is:

1. A coupling fan, comprising:

a fan body including a substantially cylinder-shaped boss, and a plurality of blades disposed on an outer peripheral surface of the boss at predetermined intervals in a circumferential direction and projecting substantially radially;

a coupling including a driving member connected to a rotary driving source, and an operating member connected to the driving member by way of a viscous substance whose viscous resistance transmits rotation of the driving member to the operating member so as to rotate the operating member; and a substantially ring-shaped mounting plate fixed to said boss of said fan body and said operating member of said coupling so as to transmit rotation of said operating member to said fan body, and including a substantially ring-shaped base member and a substantially strip-shaped movable member cut out of and projected from the base member integrally, the base member including a first fixing portion connected to one of said boss of said fan body and said operating member of said coupling, the movable member including a second fixing portion connected to another one of said boss of said fan body and said operating member of said coupling, and the first fixing portion of the base member and the second fixing portion of the movable member being disposed on an identical circumference.

2. The coupling fan according to claim 1, wherein at least one of said base member and said movable member of said mounting plate further includes a guide surface which is disposed on an inner peripheral surface thereof and which is brought into contact with said coupling, whereby positioning said mounting plate with respect to said fan body and said coupling in a radial direction.

* * * * *